US006038412A

United States Patent [19]

Hiraoka

[11] Patent Number: 6,038,412

[45] Date of Patent: Mar. 14, 2000

[54] IMAGE FIXING APPARATUS WITH GRADUATED TEMPERATURE CONTROL

[75] Inventor: Shinichiro Hiraoka, Yamatotakada, Japan

[73] Assignee: Sharp Kabushiki Kaisha, Osaka, Japan

[21] Appl. No.: 09/045,311

[22] Filed: Mar. 20, 1998

[30] Foreign Application Priority Data

Apr. 11, 1997 [JP] Japan ..... 9-092658

[51] Int. Cl.[7] ..... G03G 15/20

[52] U.S. Cl. ..... 399/69; 118/60; 219/216; 399/70; 399/94; 399/324

[58] Field of Search ..... 399/67, 69, 70, 399/320, 324, 328, 330, 331, 94; 219/216, 469; 118/60

[56] References Cited

U.S. PATENT DOCUMENTS 4,609,278 9/1986 Taniguchi ..... 399/70
4,878,092 10/1989 Arai ..... 399/70
5,742,870 4/1998 Hwang ..... 399/69
5,801,360 9/1998 Oba et al. ..... 399/69
5,862,435 1/1999 Suzumi et al. ..... 399/69

FOREIGN PATENT DOCUMENTS 60-213977 10/1985 Japan .

*Primary Examiner*—William Royer
*Assistant Examiner*—William A. Noé
*Attorney, Agent, or Firm*—David G. Conlin; Richard E. Gamache

[57] ABSTRACT

An image fixing device is disclosed comprising a heating roll installed with a heater, a pressure roll rotatably pressing against the heating roll, and a thermistor for sensing the surface temperature of the heating roll, wherein a CPU is provided for controlling the surface temperature of the heating roll to an initial fixing control temperature of 1.1 times a normal fixing temperature, when the surface temperature of the heating roll sensed by the thermistor is below one-third of the normal fixing temperature.

5 Claims, 10 Drawing Sheets

FIG.7 – PRIOR ART

FIG.11– PRIOR ART
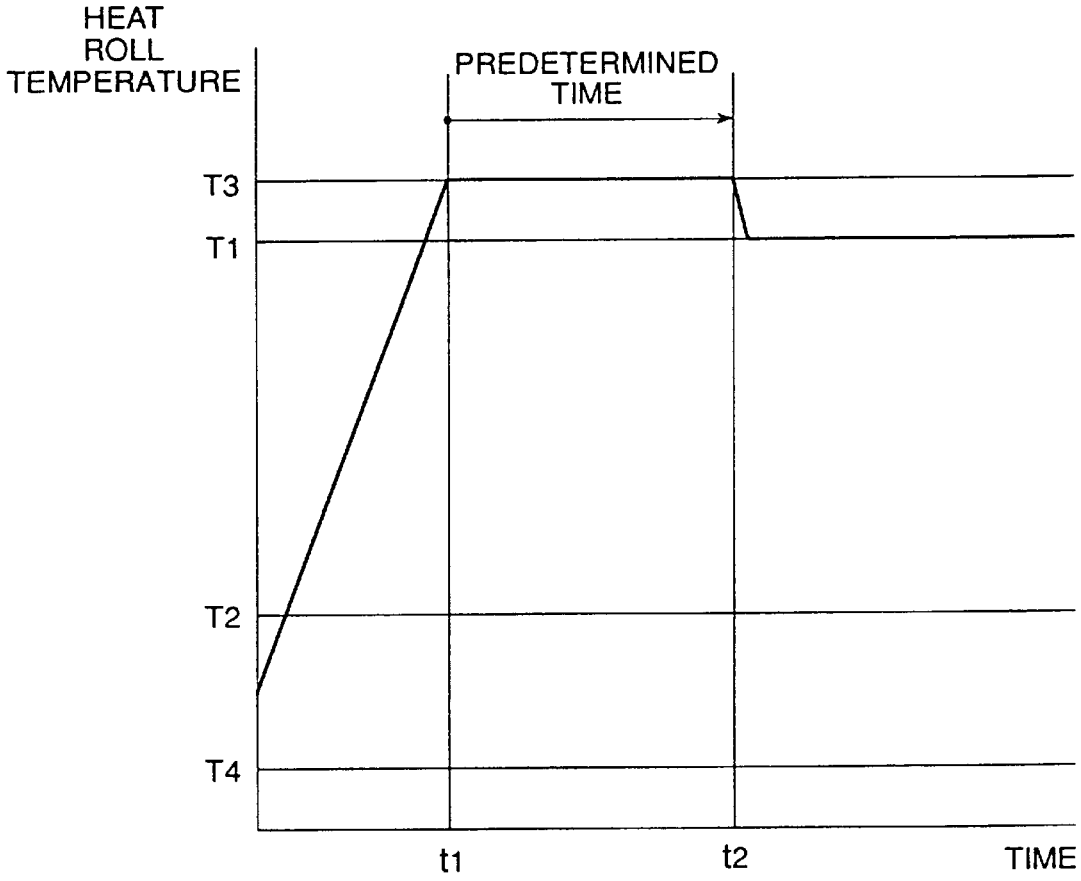

IMAGE FIXING APPARATUS WITH GRADUATED TEMPERATURE CONTROL

BACKGROUND OF THE INVENTION

The present invention relates to image forming devices such as copying machines, facsimile devices, printers and the like utilizing an electrophotograph method.

In the prior art, as is disclosed in Japanese Laid-Open Patent Publication No. 60-213977, a fixing device is proposed for sensing the surface temperature of the heating roll and controlling the temperature of the heater installed in the heating roll based on the sensed results, wherein the heater is heated to a target temperature calculated based on the surface temperature of the heating roll at the starting time of the control and the heat-up rate of the heating roll, and then stopping the heater for a predetermined time in order to prevent overshoot of the target temperature.

The above-mentioned device is suitable in a low-speed fixing device designed to have a short warm-up time. However, in a high-speed fixing device with a larger heating roll diameter and a larger pressure roll diameter, the consequence from the overshooting of the heater is rather small, and in contrast, with the fixing heat capacity being insufficient at initial printing times, the problem of the fixing ability of initial prints being poor just after the power was turned on was more serious than the overshooting of the heater. A fixing device solving such problem is disclosed in Japanese Laid Open Patent Publication No. 4-58274.

In the above-mentioned fixing device, the heat necessary for fixing the toner provided from the heating roll with high heat conduction rate to the sheet is absorbed in the pressure roll at the initial printing time just after the power is turned on, and the surface temperature of the heating roll decreases.

Further, since the pressure roll has a low temperature, the back surface of the printing sheet is cooled, resulting in the decrease of the fixing efficiency.

Therefore, in the fixing device disclosed in Japanese Laid-Open Patent Publication No. 4-58274, the power to the heater was controlled so that it is heated higher than the predetermined fixing temperature for a certain period of time after the signal to turn on the power to the heater in the heating roll is received.

SUMMARY OF THE INVENTION

However, in the device disclosed in Japanese Laid-Open Patent Publication No. 4-58274, it is necessary to set an optimum temperature condition of the initial fixing temperature when controlling the heater to heat to an initial fixing temperature which is higher than a normal fixing temperature. In the above fixing device, there is no system for determining the status of the heating roll when the power is turned on. As a result, if the power to the fixing device is turned on just after it was turned off and the power to the heater is then controlled for bringing the heating roll to an initial fixing temperature, the fixing heat may initially be too high, thereby resulting in high temperature offset problems. This is because during the time when the power to the fixing device is turned off and then immediately turned back on, the surface temperature of the heating roll does not have a chance to decrease.

Further, the heat control was operated only when the power is turned on. Therefore, when the primer is located away from the host computer as is often the case with laser printers, and when printing paper is jammed in the printer, the printer will be left with the power turned on until the jam is released. By the time the printing operation starts, the heating roll will be cooled, with no initial temperature control being operated. Even if the initial temperature control is set to be operated when the printing is started instead of when the power is turned on, it must be controlled after determining the status of the heating roll, since the heating roll may be in a heated status as was explained above, which results in the occurrence of high temperature offset problems.

Even further, in the case where the fixing device is in the power-save mode and the surface temperature of the heating roll is brought to a temperature higher than a normal initial fixing temperature after determining the status of the heating roll, the fixing heat may initially be insufficient. However, if the surface temperature of the heating roll were set higher, the power-saving effect would be reduced.

When the device is left for a long period of time at a state where the ambient temperature is low such as in the winter season, the heating roll as well as the pressure roll are cooled to a very low temperature, which leads to a longer warm-up time for the heating roll, and when the printing paper is also cooled, the fixing heat will be insufficient when the fixing is performed by the same temperature control as when the device is placed at a warmer room temperature, which results in insufficient fixing.

Further, in a printer comprising a two-sided printing function (especially a printer printing the front surface and the back surface of a paper alternately), although the predetermined time of high temperature is acceptable for fixing the toner to the front surface of the paper, residual heat will be stored in the paper, and when fixing is performed to the toner to the back surface of said paper, the fixing heat will be too high, and the melted toner will contaminate the paper and the paper transfer path.

When the heating roll is rapidly cooled to a normal fixing temperature after controlling the heat of the heating roll to a high temperature for a predetermined time, the control time at the high temperature is not long enough to sufficiently transfer the heat from the heating roll to the pressure roll, and the fixing ability of the toner will be reduced just after the reduction of the heat to the normal fixing temperature is performed, which results in uneven fixing. In contrast, when the control time at the high temperature is too long, disadvantages such as hot offset occur in the high temperature fixing operation.

The present invention aims at solving the above problems by providing a fixing device performing a stable fixing operation at all times by controlling the temperature of the heating roll so that suitable fixing is performed even at the initial printing operation, and by controlling the temperature of the heating roll depending on the status of the printer, performing a stable fixing even after a jam status or when printing is started just after the power is turned on in a winter morning.

In order to achieve the above object, the fixing device of the present invention comprises a heating roll installed with a heating means, a pressure roll rotatably pressing against said heating roll, and a temperature sensing means for sensing the surface temperature of the heating roll, wherein a temperature control means is further equipped for controlling the surface temperature of the heating roll to a temperature of an initial fixing control temperature T3 (T1×1.1) when said surface temperature of said heating roll sensed by said temperature sensing means is lower than one-third of the normal fixing temperature T1.

According to the present invention, the fixing device is characterized in that the stand-by surface temperature of said heating roll at the time of stand-by is set to be lower than one-third of the normal fixing temperature T1.

According to the present invention, the fixing device comprises a heating roll installed with a heating means, a pressure roll rotatably pressing against said heating roll, and a temperature sensing means for sensing the surface temperature of the heating roll, wherein a temperature control means is further equipped for controlling the surface temperature of the heating roll during rotation of the heating roll and the pressure roll to a temperature of a set fixing temperature T1×1.1 when said surface temperature of said heating roll sensed by said temperature sensing means is lower than a normal temperature.

According to the present invention, the fixing device is characterized in that said temperature control means controls the surface temperature of the heating roll to a temperature of T1×1.1, and after the temperature reaches the temperature of T1×1.1, further controls the temperature to a normal fixing temperature T1 in approximately 90 seconds.

According to the present invention, the fixing device is characterized in that said temperature control means controls the surface temperature of said heating roll in stages from T1×1.1 to the normal fixing temperature T1.

BRIEF DESCRIPTION OF THE DRAWINGS

FIG. 11 is an explanatory view showing the temperature change of the heating roll when controlling the temperature of the heating roll to an initial fixing temperature for a predetermined time in a prior art fixing device.

PREFERRED EMBODIMENT OF THE INVENTION

Figure 1:
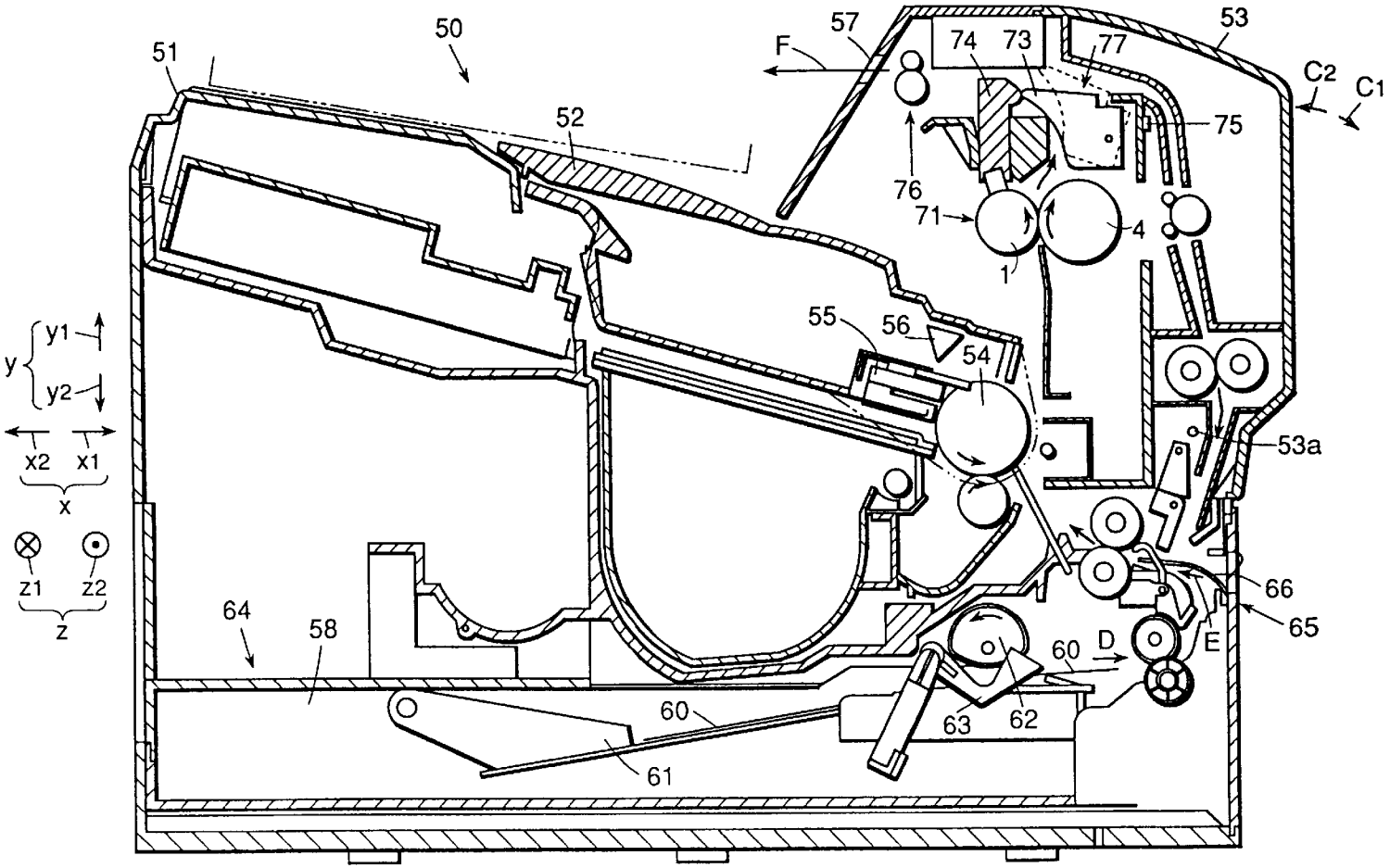
FIG. 1 is a cross-sectional view showing a laser printer enabling two-sided printing utilizing the fixing device of the present invention.
Figure 2:
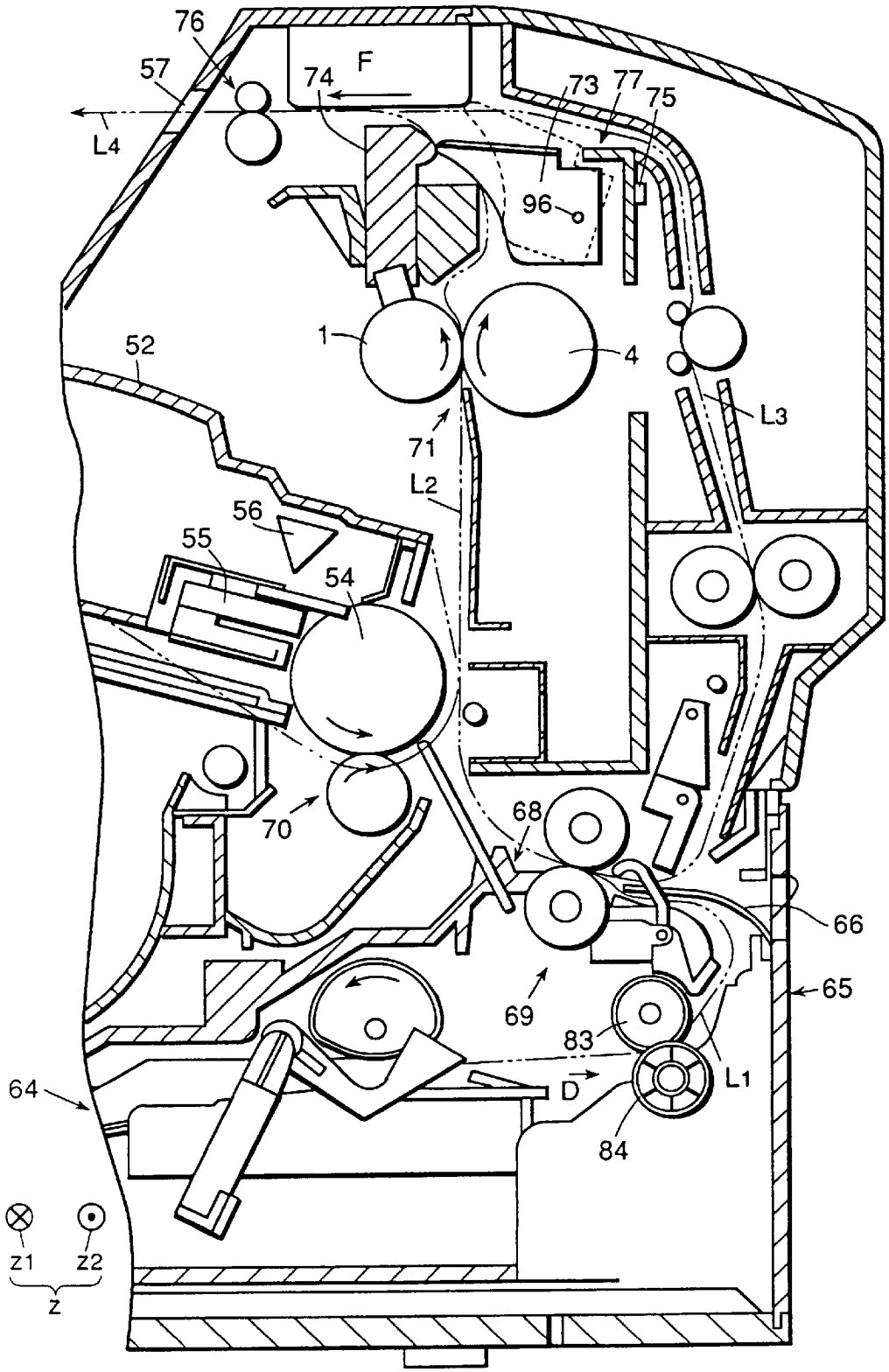
FIG. 2 is a cross-sectional view showing a right-hand side portion of FIG. 1.

The fixing device utilized in a laser printer enabling two-sided printing according to the present invention will be explained hereinafter with reference to the drawings. FIG. 1 shows a cross-sectional view of a laser printer enabling two-sided printing, and FIG. 2 shows a cross-sectional view of the right-hand side portion of the laser printer.

The general operation of the laser printer will now be explained concentrating on the structural characteristics with reference to FIGS. 1 and 2. A laser printer 50 prints an image to at least one surface or the other surface of a paper 60. Hereinafter, the surface of the paper 60 where the image is printed first will be called the "front surface", and the surface where the image is printed at the second time will be called the "back surface". The laser printer 50 is capable of printing images by a one-sided printing (first form printing or recto printing) mode and a two-sided printing (perfector printing or recto/verso printing) mode. In the one-sided printing mode, the image will be printed only to the front surface of the paper 60. In the two-sided printing mode, the image will be printed to both the front surface and the back surface of the paper 60.

Next, the structure of the laser printer 50 will be explained. The laser printer 50 comprises generally a printer body 51, a photosensitive unit 52, and a front cover 53. The photosensitive unit 52 is mounted on the upper portion of the printer body 51. The front cover 53 is mounted on the right side portion of the laser printer 50.

Hereinafter, the composition or member positioned in the arrow y1 direction from the object composition will be called "above", and the composition or member positioned in the arrow y2 direction will be called "below". The composition or member positioned in the arrow x1 direction will be called "right" and the composition or member in the arrow x2 direction will be called "left." Further, the composition or member positioned in the upstream portion of the supply of paper on which the image is to be printed will be called "one side", and the composition or member positioned in the downstream portion of the supply of paper will be called "the other side."

The photosensitive unit 52 includes a photosensitive drum 54, a discharger 55 for discharging, and a cleaner unit 56 including a waste toner box (not shown). The photosensitive unit 52 is a disposable kit which is mounted removably to the printer body 51. The front cover 53 is mounted to the printer body 51 by a pin 53 a mounted on the lower portion of the front cover 53 which enables a free angular displacement of the front cover with respect to the printer body with said pin at the center of rotation. Therefore, the front cover 53 could be opened and closed against the printer body 51 with an angular displacement to the direction of arrow C1 and C2.

On the lower portion of the printer body 51 is mounted a paper feeding means 64. This paper feeding means 64 comprises a paper tray 58, a loading member 61, a paper feeding roll 62, and a biasing member 63. A paper 60 is stored in the upper surface of the loading member 61 inside the paper tray 58 with a plurality of papers being piled inside said loading member 61. The one end of said loading member 61 which is close to the left side portion of the printer body 51 is connected by a pin to the side surface of the paper tray 58 enabling angular displacement of the loading member in the direction moving toward or away from the bottom surface. On the upper direction to the other end portion of the loading member 61 is mounted the paper feeding roll 62 whose cross-sectional shape is almost semi-circular and which comprises a plurality of rolls (not shown) in the direction of the rotational axis. Further, the other end portion of the loading member 61 is pushed to the direction moving away from the bottom surface of the paper tray 58, for example, to the upper direction, by the biasing member 63. The biasing member 63 pushes the other end portion of the loading member 61 so that the piled paper 60 and the paper feeding roll 62 maintain a predetermined distance.

For example, when an operator presses a start button mounted on the upper body of the laser printer 50, the printing of the image starts. At this time, the operator selects either a one-sided printing mode or a two-sided printing mode. When the printing starts, the paper feeding means 64 rotates the paper feeding roll 62. When the paper feeding roll 62 makes one turn, one sheet of paper 60 which is mounted on the highest position on the loading member 61 is transmitted to a paper feeding direction D toward the right side portion of the printer body 51.

A first guide means 65 is mounted on the right side portion of the laser printer 50. The first guide means 65 receives the paper 60 transmitted from the paper feeding means 64 toward the paper feeding direction D to a first transmitting path L1 by turning the paper over towards a first transmitting direction E which is opposite to the paper feeding direction D. A second guide means 68 guides the paper 60 transmitted in paper feeding direction E along the first transmitting path L1 and directs paper 60 to a second transmitting path L2 which is approximately parallel to the right side portion of the body. A first transmitting means 69 is mounted in the portion between the first guide means 66 of the first transmitting path L1 and the second guide means 68. The first transmitting means 69 transmits the paper 60 to the second guide means 68.

On the upper portion of the second guide means 68 is mounted a toner image forming means 70 with the second transmitting path L2 in between. The toner image forming means 70 forms a toner image to the back surface of the paper 60. Further, on the upper portion of the toner image forming means 70, a fixing means 71 is mounted with the second transmitting path L2 in between. The fixing means 71 fixes the surface of the toner image transferred to the paper 60. By this operation, the preferred image is printed on the front surface or the back surface of the paper 60. On the upper portion of the fixing member 71 on the second transmitting path L2 is a cleaner 74.

On the down stream of the fixing means 71 of the second transmitting path L2 is mounted a third guide means 77. The third guide means 77 comprises a movable member 73 which is capable of an angular displacement with a movable axis 96 at the center thereof. The angular displacement of the movable member 73 is sensed by a sensing means 75 on the upper portion of the fixing means 71. The third guide means 77 guides the paper 60 with the image printed to a paper discharging path L4. When two-sided printing is being performed, the paper 60 is guided from the paper discharging path to the third guide path L3.

The paper 60 which is reversed of its front and back surface by the third guide path L3 is transmitted in between a first guide roll 83 and a second guide roll 84 to the paper feeding direction D. When the paper 60 reaches the first guide means 65, it is guided by the first guide means 65 so as to reverse the transmitting direction, and it is further transmitted through the first transmitting path L1.

On the paper discharging path L4 which is down stream from the cleaner 74 to the paper discharging direction F, a second transmitting means 76 is mounted. When printing to at least one of the front or the back surface of the paper 60 is finished, the paper 60 is transmitted to the paper discharging path L4. The second transmitting means 76 transmits the paper 60 further in the direction F along the paper discharging path L4. For example, when the printing is finished and the paper 60 is being discharged, the paper 60 is transmitted to a paper discharging path L4 which is down stream from the second transmitting path L2. By this operation, the paper 60 is discharged from a paper discharging opening 57 formed on the printer body 51 in the down stream side of the paper discharging direction F by the second transmitting means 76.

Figure 3:
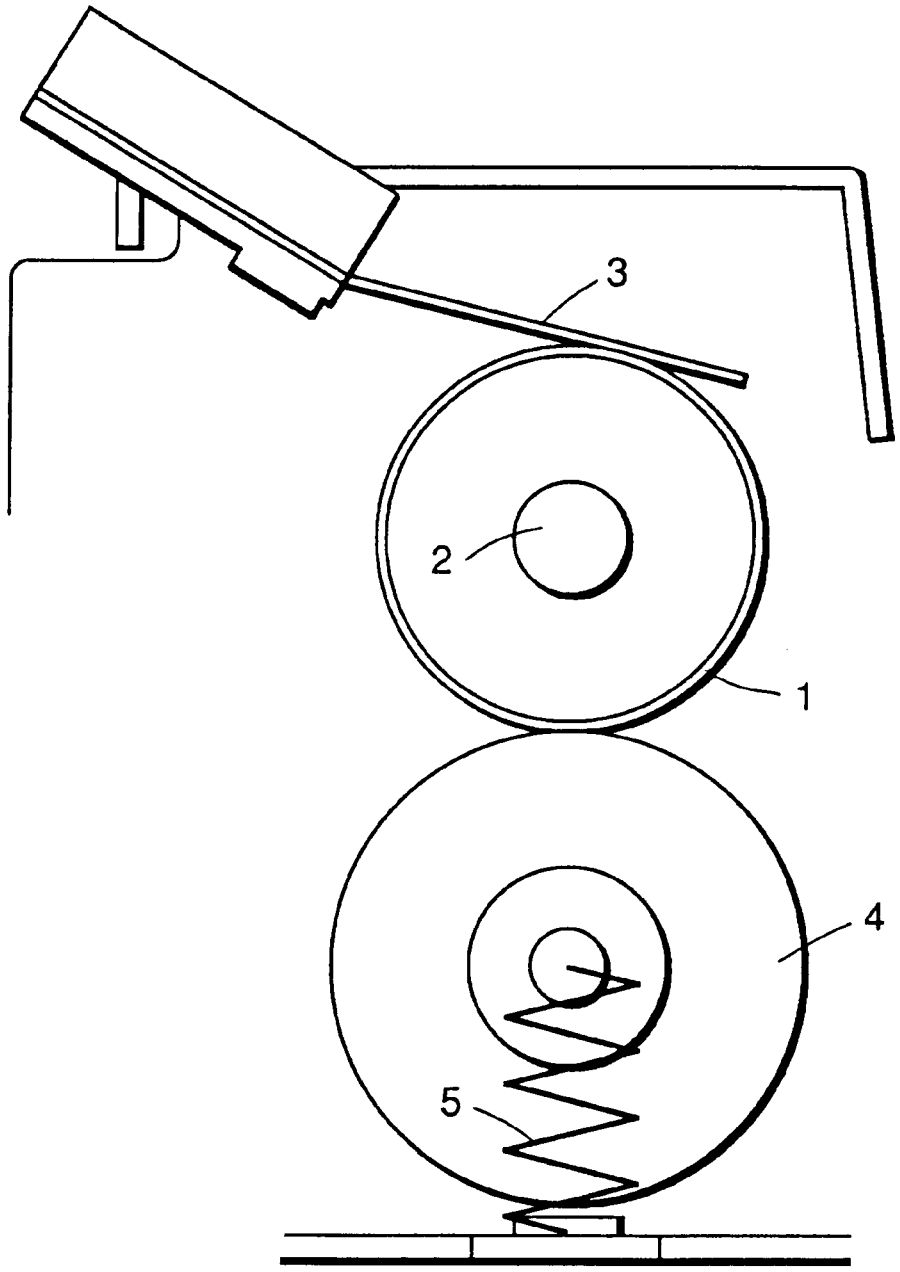
FIG. 3 is a simplified view showing the embodiment of the fixing device according to the present invention.

FIG. 3 is a view showing the general structure of the fixing device, wherein indicates a heating roll 1 installed with a heater 2, and a thermistor 3 for sensing the surface temperature on the upper portion of the heating roll 1. Numeral 4 is a pressure roll which presses against the heating roll 1 by a pressing spring 5, and which rotates dependent to the rotation of the heating roll 1.

Said heating roll 1 is formed by coating Teflon onto an aluminum pipe having an outer diameter of 20 mm and a thickness of 1.2 mm. The pressure roll 4 is injected to a metal shaft with an outer diameter of 10 mm by a rubber roll having an outer diameter of 24 mm. The pressing springs 5 are mounted on both ends of the metal shaft of the pressing roll 4, which presses the pressure roll 4 against the heating roll 1 with a load of 2 kg per each spring.

Figure 4:
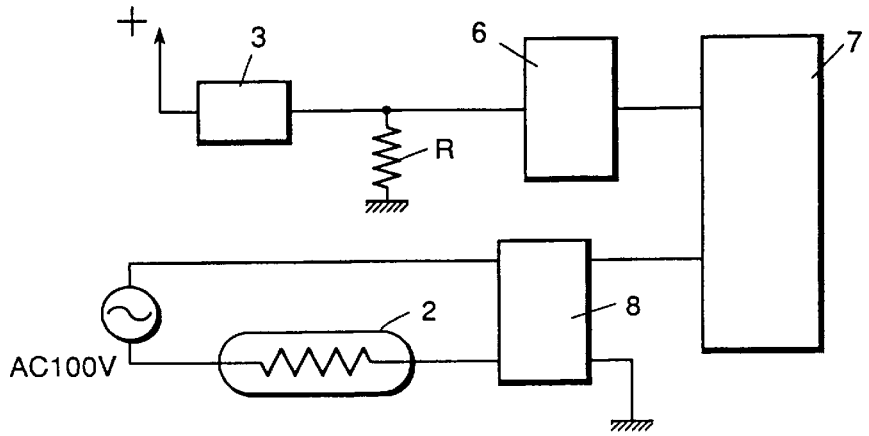
FIG. 4 is a control circuit diagram for controlling the temperature of the fixing device of the present invention.

FIG. 4 is a circuit diagram showing the control circuit used for controlling the temperature in the fixing device described above. The circuit is controlled by an A/D converter 6 and a CPU 7. Said heater 2 is connected to an alternating current power source. The thermistor 3 is connected to the A/D converter 6 and the CPU 7 through a bridge circuit (not shown), and a voltage proportional to the resistance change of the thermistor 3 is inputted thereto.

Figure 5:
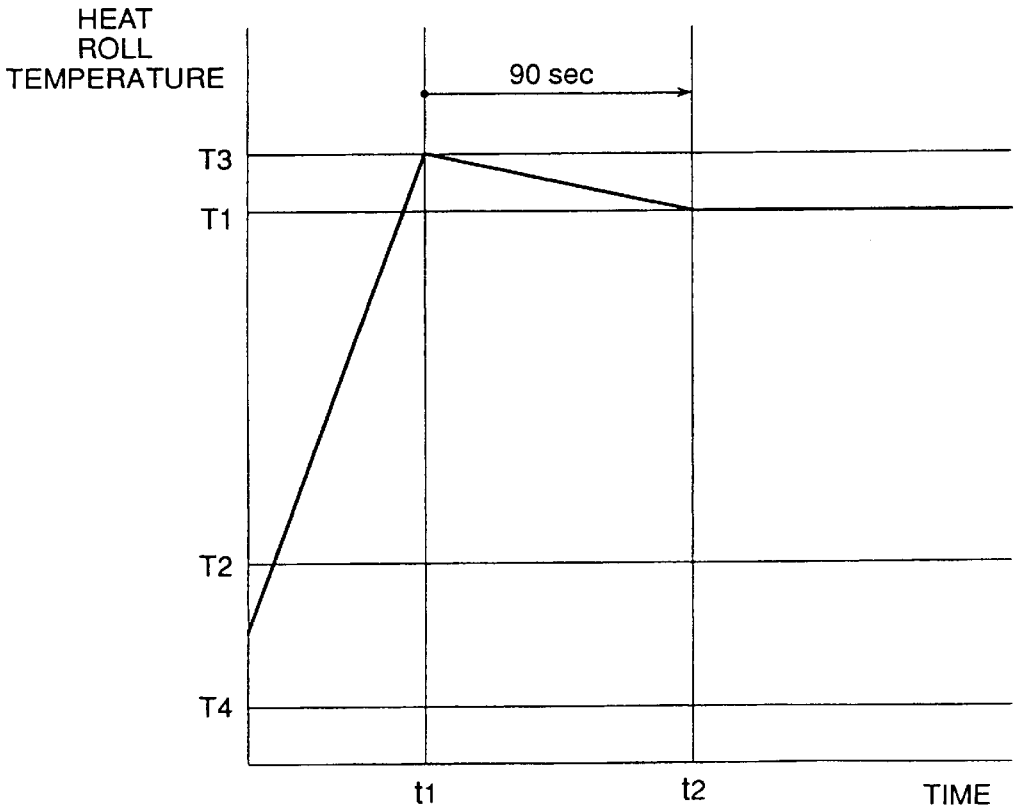
FIG. 5 is an explanatory view showing the temperature change of the heating roll when controlling temperature according to the embodiment of the fixing device of the present invention.

FIG. 5 is an explanatory view showing the temperature change of the heating roll 1 under temperature control in the fixing device explained above. The vertical axis represents the surface temperature of the heating roll 1, wherein T1 is a normal fixing temperature; T2 is a standard operation temperature (border temperature) for the initial fixing temperature, which is a temperature of T1×⅓; T3 is an initial fixing control temperature, which is a temperature of T1×1.1; and, T4 is a normal temperature, which, in the present embodiment, is set to 20° C. The horizontal axis represents the time from which the printing order is inputted to the laser printer, wherein t1 indicates the time when the printing is ready (fixing is ready), t2 indicates the time when the heating roll 1 surface temperature is reduced by the initial fixing temperature control to the normal fixing temperature T1 below the initial fixing control temperature T3.

Figure 6:
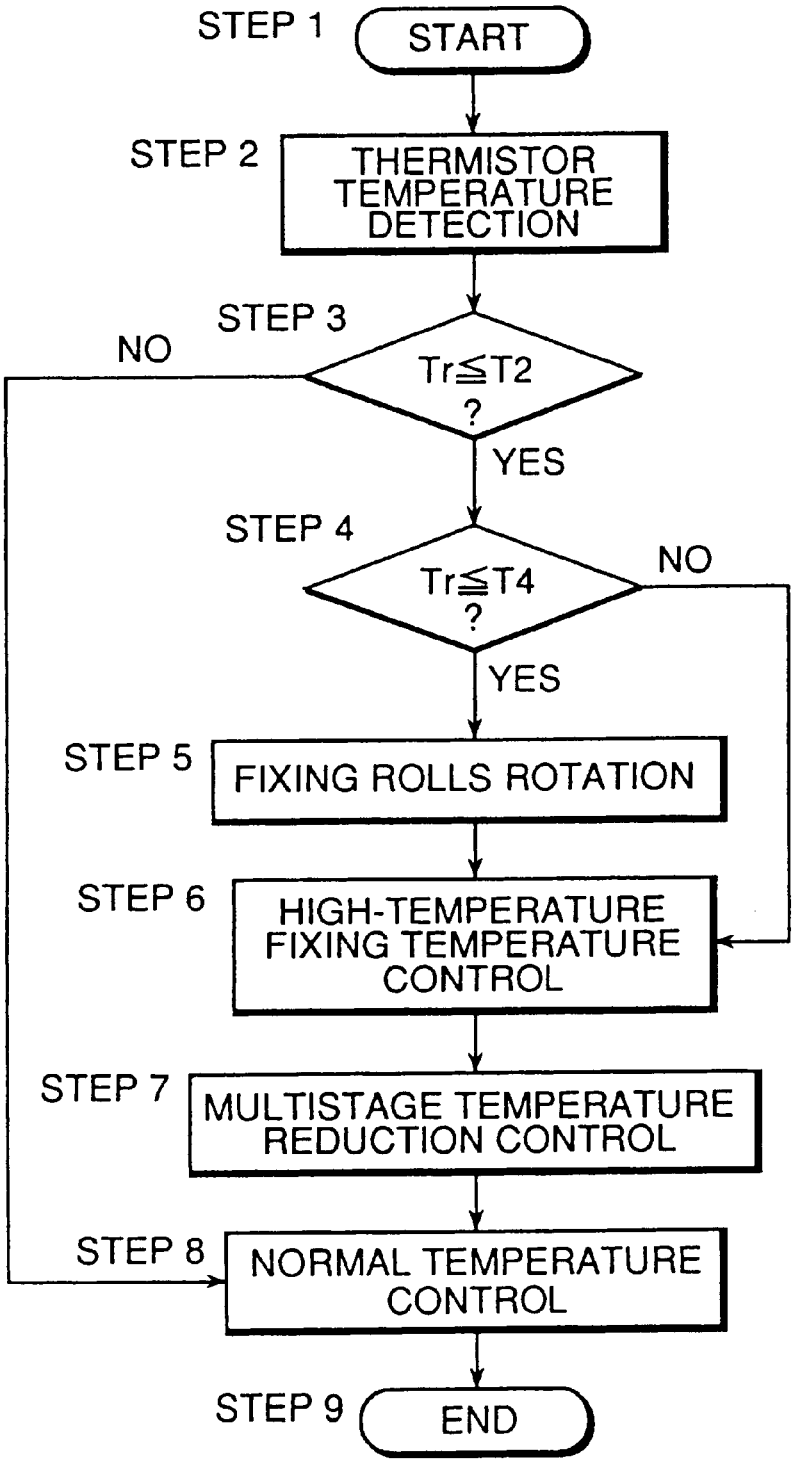
FIG. 6 is a flow chart showing the fixing temperature control operation according to the embodiment of the fixing device of the present invention.

FIG. 6 is a flow chart showing a temperature control operation according to the present embodiment, and the temperature control operation will be explained below with reference to FIG. 6.

First, when an order to start the printing is input from the host computer at Step 1, the surface temperature of the heating roll 1 is sensed by the thermistor 3 which is pressed against the heating roll 1, and it is determined whether the fixing device is at a cooled or heated state at Step 2.

Figure 7:
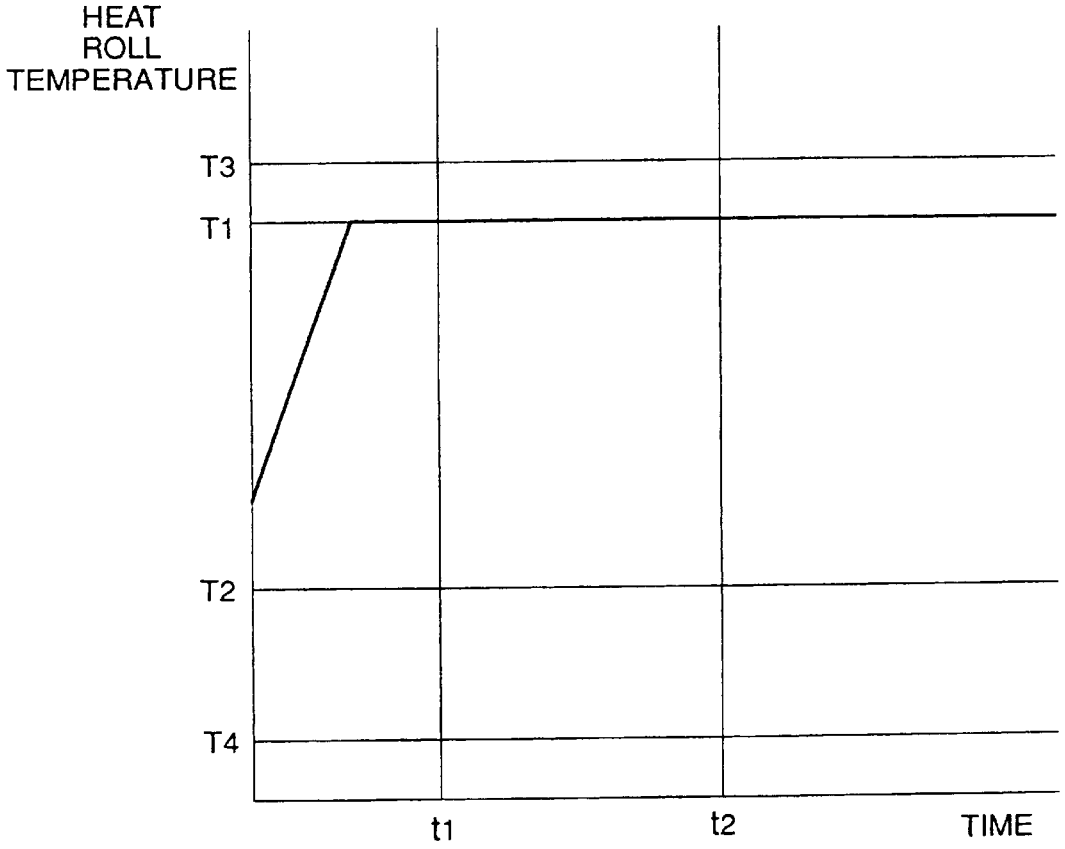
FIG. 7 is an explanatory view showing the temperature change of the heating roll when controlling temperature in a prior art fixing device.

Next, at Step 3, Tr represents the surface temperature of the heating roll 1, wherein the surface temperature Tr is compared with the standard operation temperature (border temperature) T2 of the initial fixing temperature control and if Tr≦T2 is NO, that is, if the surface temperature Tr of the heating roll 1 is higher than the standard operation temperature T2, then a normal temperature control of Step 8, that is, normal temperature control as is shown in FIG. 7, will be performed on the heating roll 1.

If Tr≦T2 is YES, that is, if the surface temperature of the heating roll 1 is lower than the standard operation temperature T2, then the ambient of where the laser printer is installed will be sensed.

Next, if Tr≦T4 is NO in Step 4, that is, if the surface temperature of the heating roll 1 is higher than a normal ambient temperature T4, then the high-temperature fixing temperature control as shown in Step 6, that is, a temperature control to an initial fixing control temperature T3 (T1×1.1) of the initial fixing temperature control will be performed.

If Tr≦T4 is YES, that is, if the surface temperature of the heating roll 1 is below normal ambient temperature T4, the fixing rolls (heating roll 1 and pressure roll 4) will be rotated as in Step 5. That is, the time t1 from the printing start order to the print ready (fixing ready) state during the initial fixing temperature control to the print ready (fixing ready) state, or in other words, during the so-called warm-up time, the fixing rolls (the heating roll 1 and the pressure roll 4) are rotated.

This is to prevent the fixing defect that may occur when printing is started under a low ambient temperature. It is to cope with the situation where heat storage speed of the pressure roll 4 is slow, as is the case when printing is started right after the power is turned on in a winter morning. The surface temperature of the heating roll 1 being below normal ambient temperature T4 is caused by the ambient temperature of the laser printer being low, and therefore when the ambient temperature of the laser printer is high, the surface temperature of the heating roll 1 will not be lower than that.

Further, the time to the print-ready state becomes longer by rotating the fixing rolls, but by this operation, the pressure roll 4 will be heated sufficiently and thoroughly, so even when a printing paper which had been cooled by the low ambient laser printer temperature is inserted to the device, a stable fixing could be performed.

At a high-temperature fixing temperature control of Step 6, when the surface temperature Tr of the heating roll 1 reaches the initial fixing control temperature T3 (T1×1.1) of the initial fixing temperature control shown in FIG. 5, then the surface temperature Tr of the heating roll 1 will be controlled in a multistage sequence towards the normal fixing temperature T1 in the multistage temperature reduction control in Step 7. Though it is shown as a straight line in FIGS. 5 and 8, the multistage temperature reduction control from T3 to T1 is performed by lowering the temperature by 3° C. every 15 seconds for six stages as is shown in FIG. 9.

Figure 8:
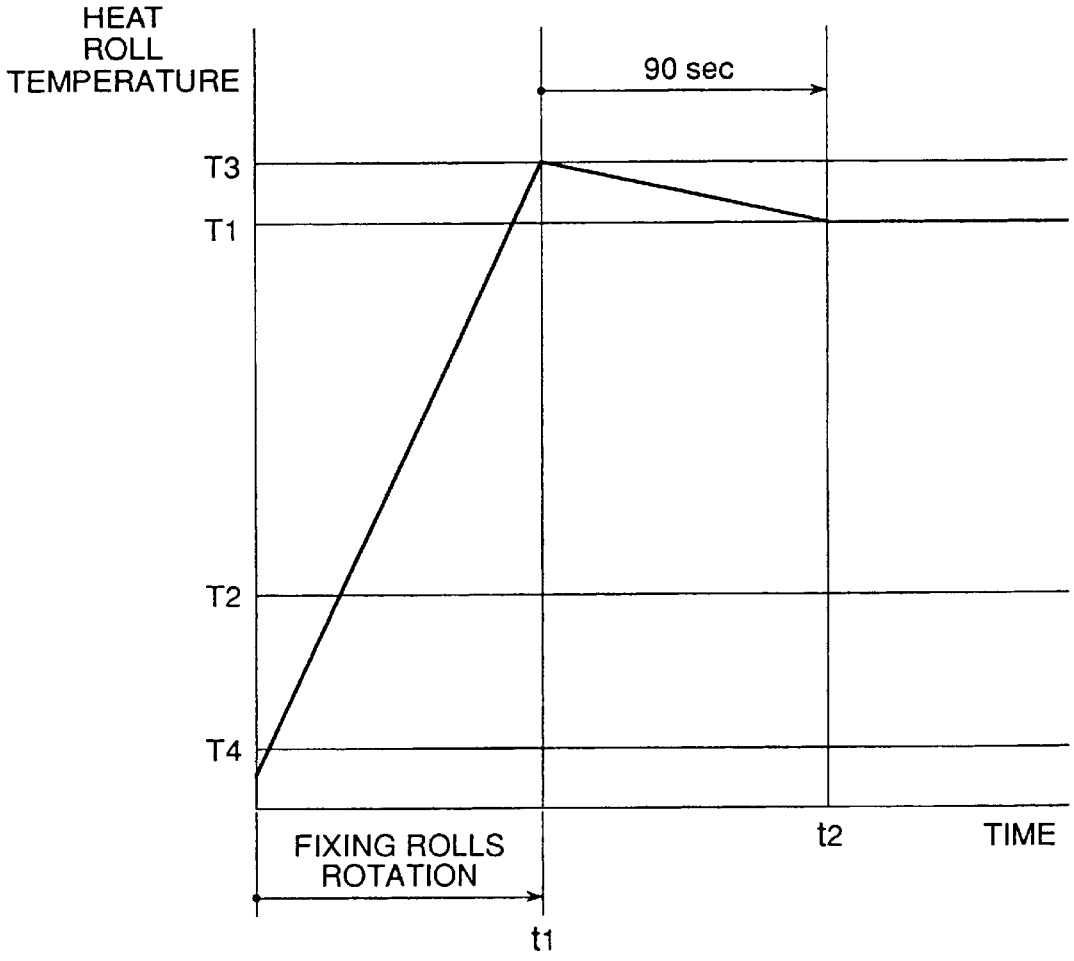
FIG. 8 is an explanatory view showing the temperature change of the heating roll when performing heat control during rotation of the heating roll and the pressure roll at the time of the warm-up in the initial fixing temperature control when the surface temperature of the heating roll is under normal temperature T4.
Figure 9:
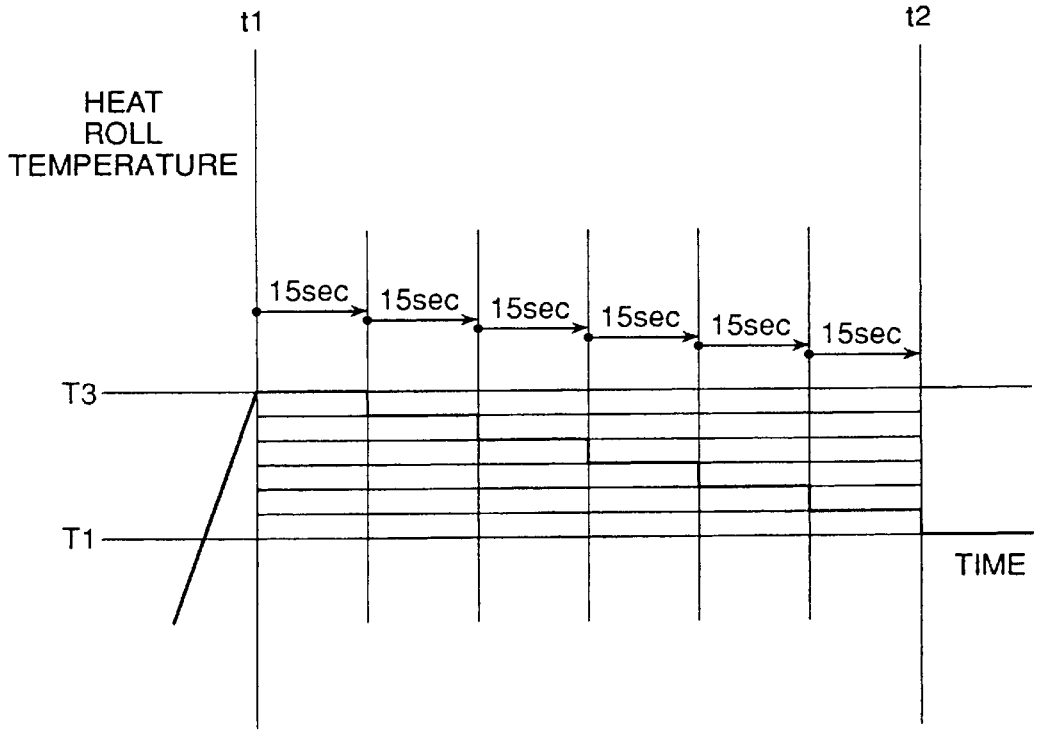
FIG. 9 is an explanatory view showing the temperature change at the temperature decreasing portion when performing a multistage temperature decrease control in the fixing device according to the present invention.

If the stages of temperature reduction are divided into a larger number, then the control will be performed approximately linearly as is shown in FIGS. 5 and 8. However, according to the experimental results being performed in the present embodiment, it showed sufficient effect when the temperature was lowered by 3° C. every 15 seconds for six stages to the normal fixing temperature T1.

Therefore, the temperature control from the initial fixing control temperature T3 to the normal fixing temperature T1 may preferably be a multistage temperature reduction control.

When the surface temperature Tr of the heating roll 1 reaches the normal fixing temperature T1, then it will be changed to the normal temperature control of Step 8, and will be ended at Step 9.

Even if the paper of the initial printing is only one sheet, a multistage temperature reduction control from the initial fixing control temperature T3 to the normal fixing temperature T1 will be performed. When the surface temperature Tr of the heating roll 1 reaches the normal fixing temperature T1, then the normal fixing temperature T1 may be maintained by a stand-by mode, or it may be controlled to a standard operation temperature (border temperature) T2 of the initial fixing temperature control or below by a power-save mode (sleep mode) or waiting mode.

The laser printer used in the present embodiment is capable of a processing speed of 70 mm/sec, one-sided printing of 12 sheets/min, and a two-sided printing of 4 sheets/min, wherein the optimum normal fixing temperature T1, the optimum initial fixing control temperature T3, and the standard operation temperature (border temperature) T2 of the initial fixing temperature control when considering the fixing ability of the one-sided and the two-sided printing and the problems resulting from fixing in high temperature are best be set as follows: T1=190° C., T2=65° C., T3=208° C., wherein heating roll 1 surface temperature Tr is set to be reduced to the optimum fixing temperature T1 in 90 seconds by 6 stages, reducing 3° C. every 15 seconds.

When the initial fixing control temperature T3 is set to be higher than 210° C., then problems described below will occur.

(1) The time from when the printer receives the order to start printing to the real start of the printing for the first sheet (first printing) becomes longer.

By the level (the printing speed) of the laser printer being used in the present embodiment, the aim of the first printing is 60 seconds, but when the initial fixing control temperature T3 is set to be higher than 210° C., then the first printing will exceed 60 seconds.

Figure 10A:
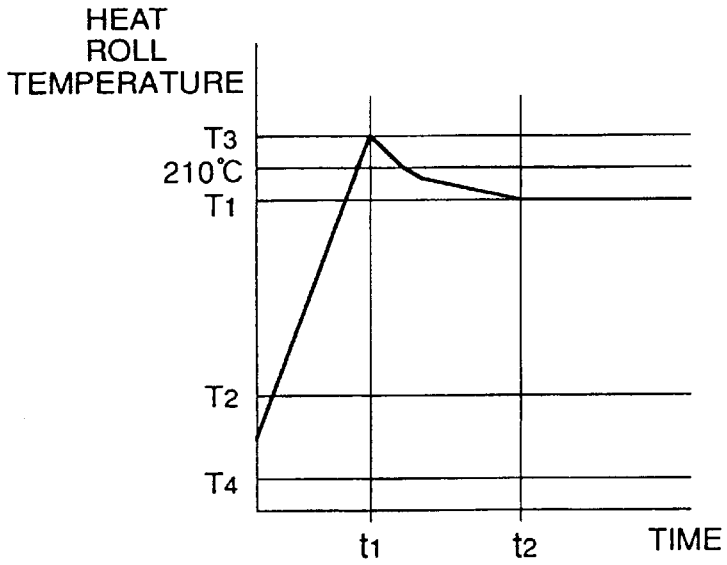
FIG. 10A is an explanatory view showing the temperature change of the heating roll when controlling a rapid temperature decrease in the multistage temperature decrease control.
Figure 10B:
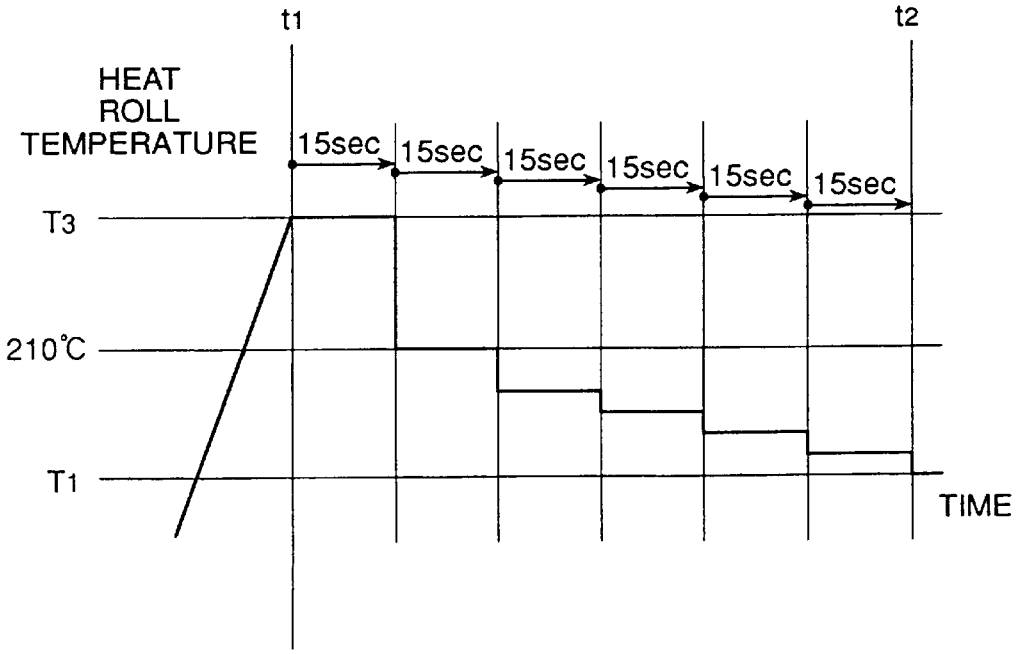
FIG. 10B is an explanatory view showing the temperature change of the temperature decreasing portion when performing a rapid temperature decrease in the multistage temperature decrease control.

(2) In the case where the initial printing is of a continuing plurality printing, the multistage temperature reduction control from the initial fixing control temperature T3 to the normal fixing temperature T1 must be performed by a rapid reduction as is shown by the radical curve in FIGS. 10A and 10B, which leads to a complicated temperature control operation.

If the fixing temperature for the first sheet is too high, then problems are likely to occur to the second end third streets by the high temperature fixing. Especially in the two-sided printing, the heat stored in the printing paper (sheet) will be large, so the heat will be too high when performing fixing to the back surface, and contamination is likely to occur to the printing paper and to the paper transmitting path by the melted toner.

The above-mentioned problem becomes worse when the initial fixing control temperature T3 becomes larger, so the optimum initial fixing control temperature T3 should be set to approximately around normal fixing temperature T1×1.1.

However, in order to fulfill such condition, the status of the fixing rolls (heating roll 1, pressure roll 4) at the time of starting the printing becomes important. When the fixing rolls are heated at the time of starting the printing, if the above-mentioned initial fixing temperature control is performed, problems according to high-temperature fixing will occur even if the initial fixing control temperature T3 is a normal fixing temperature T1×1.1.

In the embodiment of the present invention, the standard operation temperature T2 of the initial fixing temperature control is set at 65° C. However, no problem should occur when the standard operation temperature T2 is set at approximately ⅓ of the normal fixing temperature T1. Regarding the standard operation temperature T2, it is confirmed by experiment that it may be set to a range of ±10° C. of the value of T1×⅓.

Further, the temperature of the fixing rolls in the power-save mode (sleep mode) should be set to the standard operation temperature T2 of the initial fixing temperature control. The reason for this is because a laser printer connected to a personal computer is apt to have high tendency to perform an intermittent print out, and when putting emphasis on the fixing performance in such use, initial fixing temperature control should be performed when printing from the power-save mode. If the temperature of the fixing rolls is lower than the standard operation temperature T2, the time from when the laser printer receives the order to start printing to the time to start the printing of the first sheet (first printing) becomes long. Therefore, it is best to set the temperature of the power-save mode (sleep mode) to the standard operation temperature T2 of the initial fixing temperature control.

When the fixing rolls are cooled at the time to start printing (below normal ambient temperature), the fixing will not be sufficient even when the initial fixing control temperature T3 is set to the normal fixing temperature T1×1.1. This is because when the ambient temperature is low, the heating speed of the fixing rolls will be slow after turning the heater on, and that the printing paper is also cold, lacking heat necessary to fix the toner. Therefore, as was explained above, the fixing rolls (heating roll 1 and pressure roll 4) are controlled so as to rotate at the time of the warm-up of the initial fixing temperature control (high-temperature fixing temperature control) as is shown in FIG. 8. Regarding normal ambient temperature T4, the setting temperature may be in the range of 15° C. through 25° C. according to experimental results, but the normal ambient temperature T4 should be in the range of 15° C. through 20° C.

The best temperature change (temperature control) from the initial fixing control temperature T3 to the normal fixing temperature T1 was a multistage reduction of 90 seconds by the experiment shown in Tables 1 and 2. FIG. 11 shows the temperature change according to a prior art temperature control, and Table 1 shows a result when the predetermined time of the initial fixing control temperature T3 is changed when performing a continuous printing. Table 2 shows the result when the changing time from the initial fixing control temperature T3 to the normal fixing temperature T1 is changed in the initial fixing temperature control (FIG. 5) of the present embodiment.

TABLE 1

| Predetermined time of T3 (sec.) | 30 | 60 | 90 | 120 | 150 | 180 |
|---|---|---|---|---|---|---|
| Fixing ability | X | Δ | O | O | O | O |
| High-temperature (hot) offset | O | O | Δ | X | X | X |
| Contamination at the time of two-sided printing | O | Δ | X | X | X | X |

TABLE 2

| T3 → T1 time (sec.) | 30 | 60 | 90 | 120 | 150 | 180 |
|---|---|---|---|---|---|---|
| Fixing ability | X | Δ | O | O | O | O |
| High-temperature (hot) offset | O | O | O | O | Δ | X |
| Contamination at the time of two-sided printing | O | O | O | Δ | X | X |

In the experimental results shown in Table 1, the X and A of the fixing ability show the defective fixing ability when temperature is rapidly reduced from the initial fixing control temperature T3 to the normal fixing temperature T1. If the predetermined time of the initial fixing control temperature T3 is set longer, the fixing ability will be improved even during continuous printing, but it could be understood that problems based on high-temperature fixing such as hot offset and contamination during two-sided printing will occur. Therefore, by experimenting the initial fixing temperature control (FIG. 5) of the present embodiment, it was understood that a time of approximately 90 seconds is best.

The present embodiment was explained using a laser printer, but it is not limited to laser printers, but could be a copying machine or a facsimile using electrophotograph methods.

According to the fixing device disclosed in the present invention, the heat sensing means contacting the heating roll 1 senses the surface temperature of the heating roll 1 to determine the condition of the heating roll 1, and when the heating roll is cooled, set to start the fixing at a predetermined temperature of an initial fixing control temperature T1×1.1, which enables a suitable and stable fixing without adding any cost, since no special member should be added.

According to the fixing device of the present invention, the surface temperature of heating roll 1 during the waiting time is set to be below ⅓ of the fixed set temperature T1, so a stable and suitable fixing could be gained at the initial time of printing from the waiting mode, and the best power-saving effect could be gained at the waiting time.

According to the fixing device of the present invention, even in the case where ambient temperature is especially low as in the winter season, the device senses the heating roll 1 being cooler than the normal ambient temperature T4, and the heating roll 1 and the pressure roll 4 are rotated and warmed, so a stable and suitable fixing can be performed.

According to the fixing device of the present invention, the heating roll 1 surface temperature is reduced from the initial fixing control temperature T3 (T1×1.1) to the normal fixing temperature T1 in approximately 90 seconds so problems or contamination caused by high temperature fixing will not occur even when continuous printing of the two-sided printing is performed, and a stable and suitable fixing can be performed.

According to the fixing device of the present invention, the heating roll 1 surface temperature is reduced from the initial fixing control temperature T3 (T1×1.1) to the normal fixing temperature T1 in a multistage sequence, so problems or contamination caused by high temperature fixing will not occur even when continuous two-sided printing is performed, and a stable and suitable fixing will be performed.

I claim:

1. An image fixing device comprising a heating roll installed with a heating means, a pressure roll rotatably pressing against said heating roll, and a temperature sensing means for sensing a surface temperature of the heating roll:

wherein a driving means is provided for driving the heating roll and the pressure roll into rotation, and a temperature control means is provided for controlling the surface temperature of the heating roll until it reaches a temperature of an initial fixing control temperature T3 (T1×1.1), T1 being a normal fixing temperature, when said surface temperature of said heating roll sensed by said temperature sensing means is lower than a standard operating temperature T2 and also lower than a normal ambient temperature T4.

2. The image fixing device of claim 1 wherein the surface temperature of said heating roll at a time of stand-by is set lower than one-third of the normal fixing temperature T1.

3. An image fixing device comprising a heating roll installed with a heating means, a pressure roll rotatably pressing against said heating roll, and a temperature sensing means for sensing a surface temperature of the heating roll:

wherein a temperature control means is provided for controlling the surface temperature of the heating roll to an initial fixing control temperature T3 (T1×1.1) during rotation of the heating roll and the pressure roll, T1 being a normal fixing temperature, when said surface temperature of said heating roll sensed by said temperature sensing means is lower than a standard operating temperature T2 and also lower than a normal ambient temperature T4.

4. The image fixing device of claim 1 or claim 3 wherein said temperature control means controls the surface temperature of the heating roll to the initial fixing control temperature T3, and after the temperature reaches the initial fixing control temperature T3, further controls the surface temperature of the heating roll to the normal fixing temperature T1 in approximately 90 seconds.

5. The image fixing device of claim 4 wherein said temperature control means controls the surface temperature of said heating roll in stages from the initial fixing control temperature T3 to the normal fixing temperature T1.

* * * * *